US006554599B2

(12) United States Patent
Goodall et al.

(10) Patent No.: US 6,554,599 B2
(45) Date of Patent: Apr. 29, 2003

(54) APPARATUS FOR SPIRAL-BOSS HETEROFIL SPINNERET

(75) Inventors: James Richard Goodall, Charlotte, NC (US); John Stanley McConnell, Salisbury, NC (US); Allan James Hastie, Charlotte, NC (US)

(73) Assignee: Arteva North America S.A.R.L., Zurich (CH)

( * ) Notice: Subject to any disclaimer, the term of this patent is extended or adjusted under 35 U.S.C. 154(b) by 129 days.

(21) Appl. No.: 09/827,792

(22) Filed: Apr. 6, 2001

(65) Prior Publication Data

US 2002/0145225 A1 Oct. 10, 2002

(51) Int. Cl.[7] ..... B29C 47/00; D01D 5/34

(52) U.S. Cl. ..... 425/131.5; 425/382.2; 425/464; 425/DIG. 217

(58) Field of Search ..... 425/131.5, 133.1, 425/464, 463, 467, 72.2, DIG. 217, 382.2; 264/DIG. 26, 171.1, 172.11, 172.14, 172.15

(56) References Cited

U.S. PATENT DOCUMENTS

| | | | | |
|---|---|---|---|---|
| 3,716,317 A | | 2/1973 | Williams, Jr. et al. | 425/198 |
| 4,376,743 A | | 3/1983 | Dees | 264/103 |
| 4,411,852 A | | 10/1983 | Bromley et al. | 264/171 |
| 5,256,050 A | | 10/1993 | Davies | 425/131.5 |
| 5,393,219 A | * | 2/1995 | Hagen et al. | 425/382.2 |
| 5,505,889 A | | 4/1996 | Davies | 264/173.16 |
| 5,624,754 A | * | 4/1997 | Choe et al. | 428/373 |
| 5,654,097 A | * | 8/1997 | Choe et al. | 428/373 |
| 5,773,144 A | * | 6/1998 | Choe et al. | 428/373 |

FOREIGN PATENT DOCUMENTS

EP 0 514 084 A2 11/1992

* cited by examiner

*Primary Examiner*—Robert Davis
*Assistant Examiner*—Joseph S Del Sole
(74) *Attorney, Agent, or Firm*—Gregory N. Clements

(57) ABSTRACT

An apparatus to increase the orifice density in a spinneret by using an elongate boss having a plurality of orifices. The apparatus is for spinning bicomponent sheath/core filaments. The apparatus includes a distributor plate, and spinneret and a shim position between the distributor plate and the spinneret. The spinneret includes a plurality of elongate bosses spaced apart by channels. Each boss having a plurality of orifices of which the distance between the orifices are restricted only by manufacturing tolerances.

12 Claims, 5 Drawing Sheets

APPARATUS FOR SPIRAL-BOSS HETEROFIL SPINNERET

BACKGROUND OF THE INVENTION

1) Field of the Invention

The present invention relates to a method and apparatus for spinning bicomponent filaments in a sheath/core polymer configuration. More particularly, the invention relates to a spinneret, used for bicomponent spinning, having a plurality of orifices in a boss.

2) Description of Prior Art

Bicomponent filaments of the sheath/core configuration are well-known and a variety of spinning packs and spinnerets have been employed in the production of such filaments. A conventional spinning assembly involves feeding molten sheath forming material to the spinneret orifices, in a direction perpendicular to the orifices, and injecting molten core forming material into the sheath-forming material as it flows into the spinneret orifices.

As disclosed in U.S. Pat. No. 5,505,889 to Davies, prior art bicomponent spinnerets provide one orifice per boss. Boss spacing, and consequently orifice density, is restricted by a manufacturing requirement of one millimeter spacing between adjacent bosses. An increased orifice density yields a corresponding increase in the number of filaments produced. Accordingly, there is a need for an improved spinneret with an increased orifice density.

SUMMARY OF THE INVENTION

The present invention is directed towards a spinneret assembly and method for spinning bicomponent filaments. According to the present invention, the spinneret assembly includes a distributor and a spinneret. The distributor is provided with inner openings near the center of the distributor and with outer openings further from the center. The inner openings convey molten sheath polymer to the spinneret and the outer openings convey molten core polymer to the spinneret. The spinneret is provided with an integral boss having a plurality of orifices for receiving core polymer which coaxially align with the distributor outer openings for receiving core polymer. By providing the spinneret with an integral boss having multiple orifices, orifice density is increased over prior art spinnerets which contain one orifice per boss. Orifices on the same boss can be manufactured closer to each other than orifices on adjacent bosses. The spinneret is also provided with a plurality of openings and recessed pathways adjacent to the boss for conveying sheath polymer to the orifices.

According to another aspect of the present invention, the bosses are curvilinear. Still further aspects of the present invention include spiral, semi-circular or linear bosses.

According to another aspect of the present invention, a method is provided for making a bicomponent filament. The method includes providing a distributor having an inner flow passage and outer flow passages, providing a spinneret beneath the distributor having a plurality of bosses which have a plurality of orifices aligning with the outer flow passages, forcing core polymer through the outer flow passages and the spinneret openings, forcing sheath polymer through the inner flow passage and onto recessed pathways provided adjacent to the boss, and forcing the sheath polymer through the recessed pathways, over the bosses, then through the spinneret openings to form a sheath about the core polymer.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
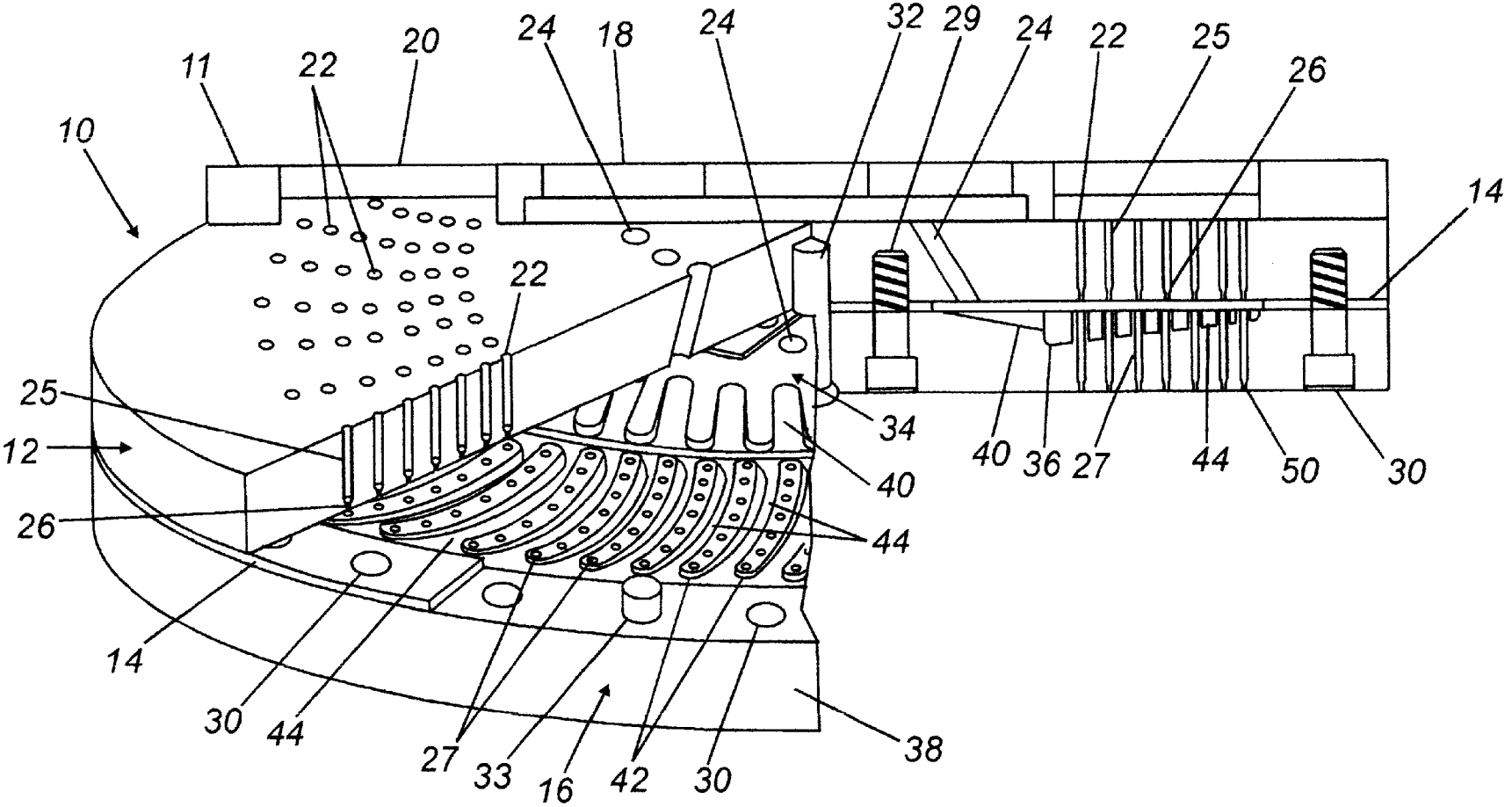
FIG. 1 is a fragmented perspective view of a spin pack assembly according to the preferred embodiment of the invention.
Figure 2:
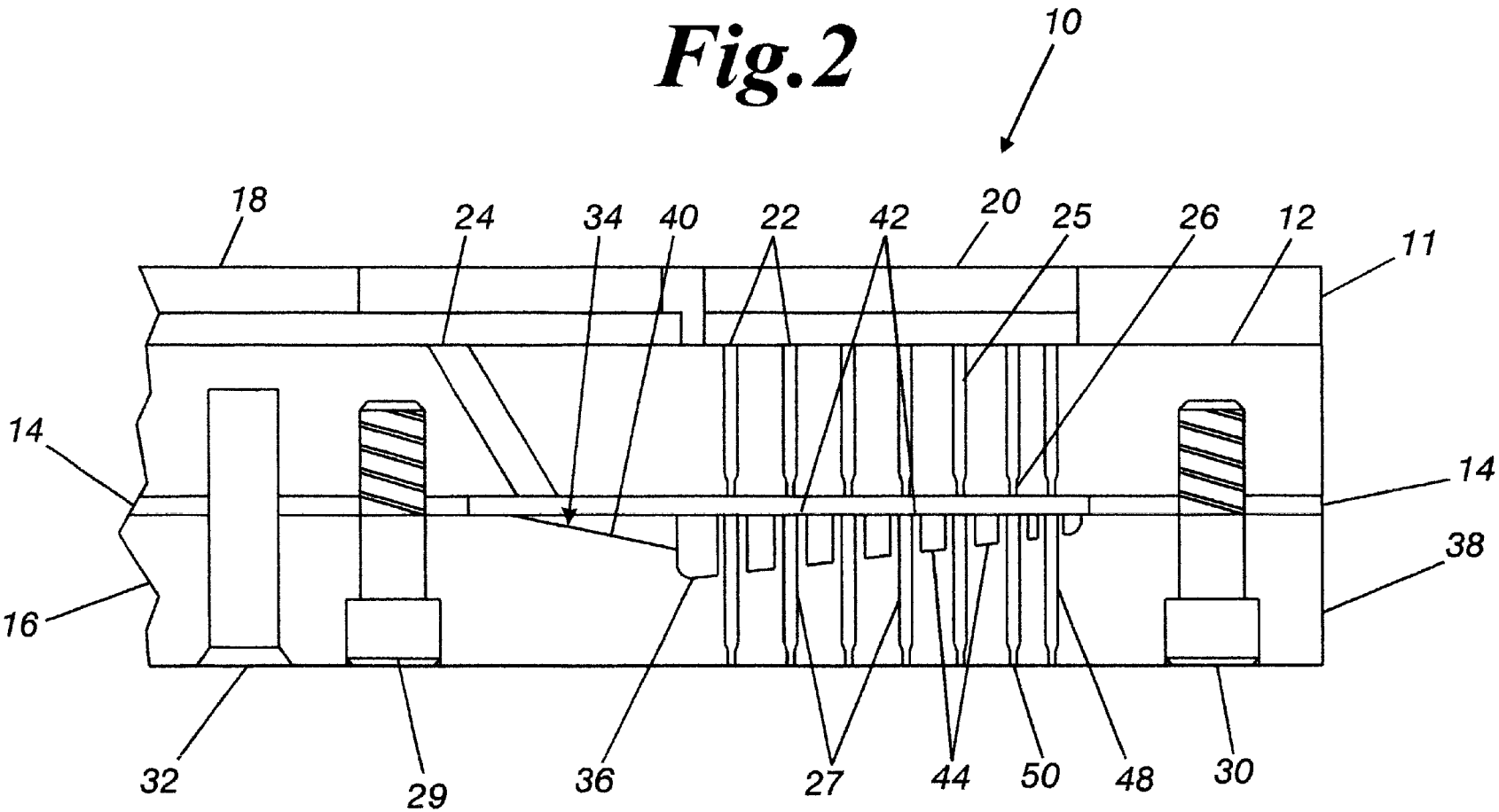
FIG. 2 is a fragmented view, in cross section, of the spin pack assembly of FIG. 1.

FIGS. 1 and 2 illustrate a spin pack assembly 10 according to the present invention. The spin pack assembly 10 includes a supply manifold 11, a distributor 12, a shim 14 and a spinneret 16. The manifold 11 delivers molten sheath polymer and molten core polyester through respective feed conduits 18, 20 to the distributor 12. The sheath and core polymers can be any melt spinnable polymer such as, for example, polyolefin, polyester or nylon. The sheath and core polymers are passed to the respective feed conduits 18, 20 by conventional pump and filter means not herein illustrated. The distributor 12 is positioned beneath the manifold 11 to receive the sheath and core polymers.

The distributor 12 includes outer passages 22 to form the core polymer into filaments and inner passages 24 to convey the flow of sheath polymer to the spinneret 16. Radial feed channels can be provided about the center of the distributor 12 to direct sheath polymer from the feed conduit 18 to the inner passages 24. The inner passages 24 can be vertical or can be slanted as necessary to avoid obstructions such as bolts. The outer passages 22 have an upper counterbore 25 and a lower tapered bottom 26 to provide a core filament of the desired diameter. The outer passages 22 are arranged to coaxially align with spinneret orifices 27.

The shim 14 has a substantially uniform thickness and is positioned between, and slightly separates, the distributor 12 and the spinneret 16. Preferably the shim 14 is constructed with a separate inner and outer section. The inner and outer shim 14 sections are maintained in fixed relationship to the distributor 12 and spinneret 16 by a respective ring of inner and outer bolts 29, 30 engaging threaded recesses in the distributor 12. The bolts 29, 30 also overcome bowing and separation of the distributor 12 and spinneret 16. The distributor 12 and spinneret 16 are relatively positioned by a central dowel pin 32 in the center of the spin pack 10 and outer dowel pins 33 interspersed along the outer ring of bolts 30. Alternatively, the shim can be unitary. The unitary shim substantially covers the spinneret and has openings provided in alignment with distributor passages 22, 24 and spinneret orifices 27. The shim 14 can be manufactured from a variety of materials such as stainless steel or brass. The thickness of the shim 14 is selected according to a variety of operating parameters such as the sheath polymer viscosity and desired pressure drop across the top of the spinneret 16.

The spinneret 16 includes a central hub 34, a recessed section 36 and an outer rim 38. The central hub 34 preferably is provided with radially outward directed feed channels 40 for conveying the sheath polymer to the recessed section 36 of the spinneret 16. The recessed section 36 is preferably sloped upwards from the central hub 34 to the outer rim 38 to maintain the sheath polymer under constant pressure. The recessed section 36 is provided with vertically extending elongate bosses 42 thereby forming pathways 44 between the bosses 42. The bosses 42 extend upward terminating in a plane common to the upper surface of the outer rim 38 and the central hub 34. The rate of outward flow of sheath polymer through the pathways 44 and over the bosses 42 to the orifices 27 is a result of the pressure drop determined by the shim gap between the distributor 12 and the spinneret 16. The depth of the pathways 44 are selected to provide a low pressure drop radially across the top of the spinneret 16, and the shim 14 thickness is selected to provide a higher pressure drop across the bosses 42. The outer rim 38 forms an outer boundary restricting the sheath polymer and includes the outer rings of bolts 30 joining the distributor 12, shim 14 and spinneret 16.

Figure 3:
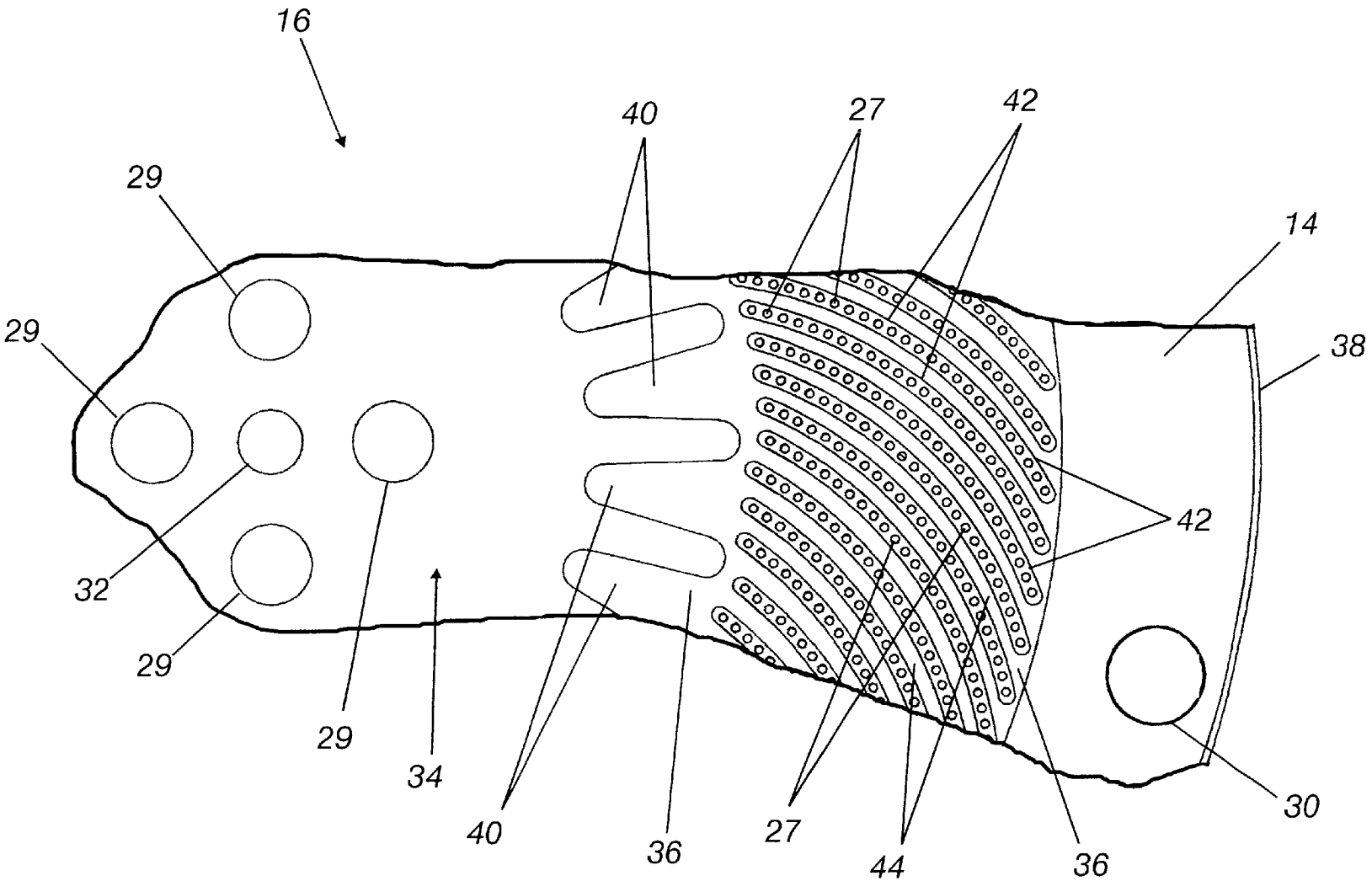
FIG. 3 is a fragmented plan view of a spinneret having elongate spiral bosses.
Figure 4:
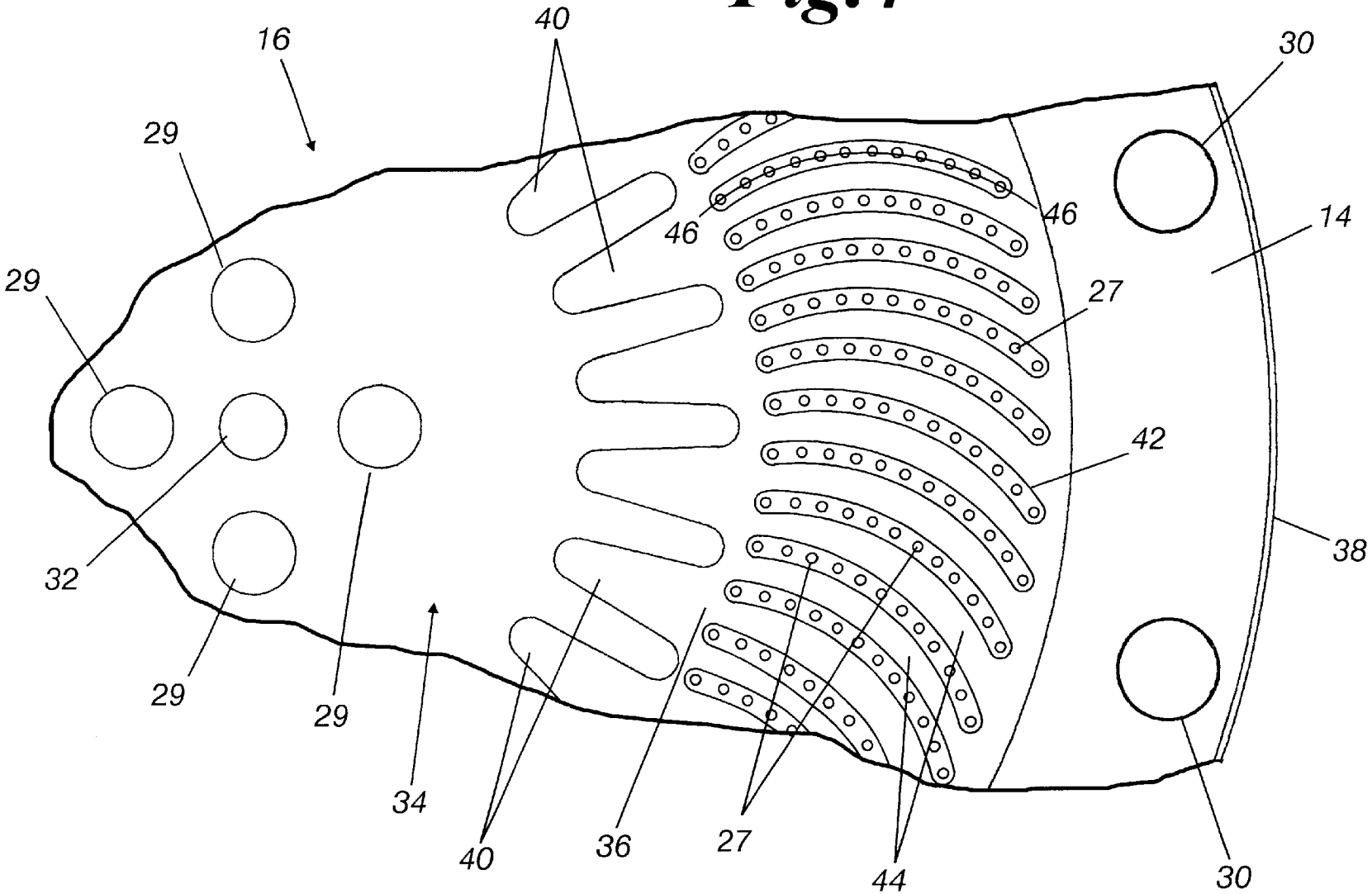
FIG. 4 is a fragmented plan view of a spinneret having elongate semi-circular bosses.
Figure 5:
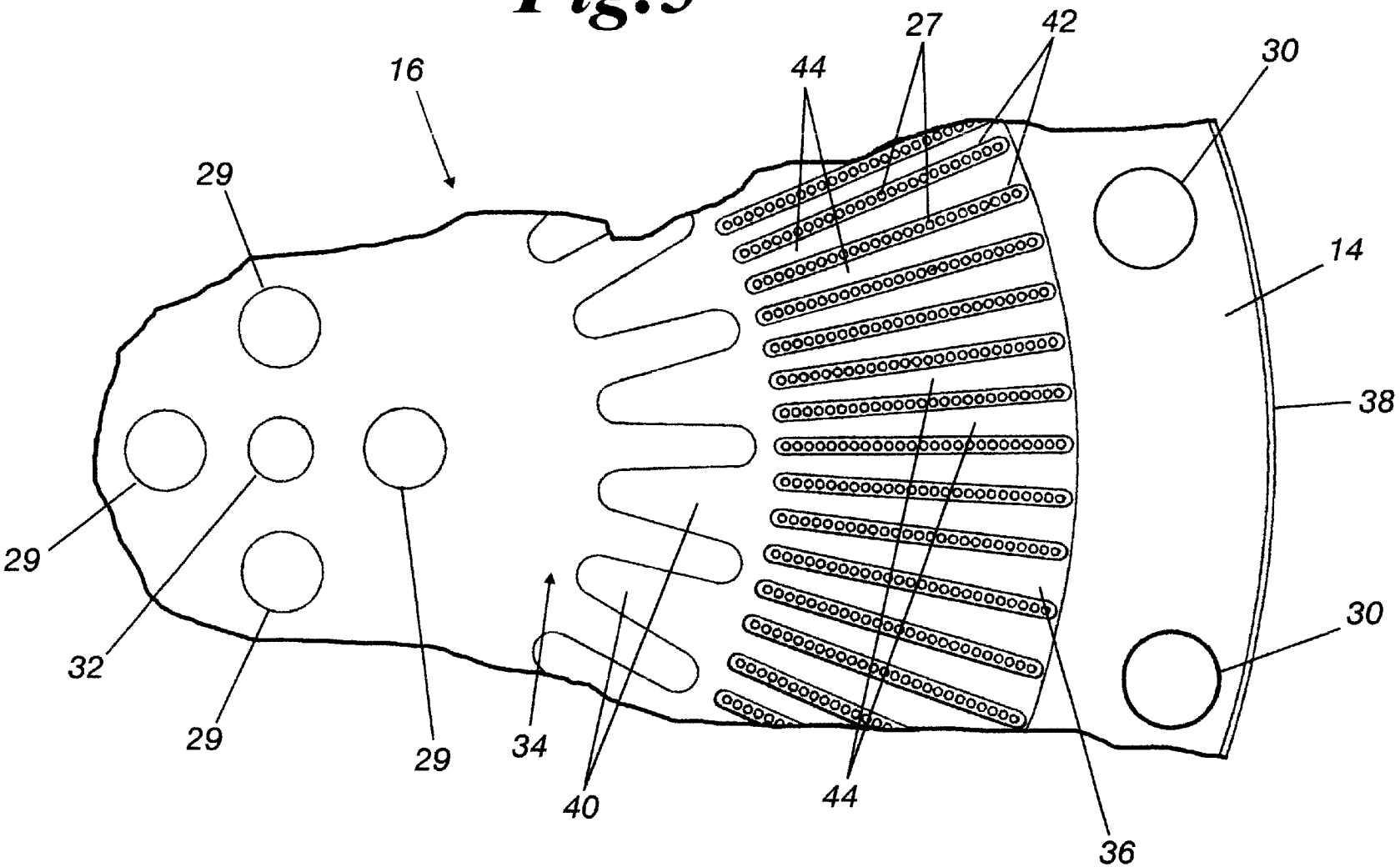
FIG. 5 is a fragmented plan view of a spinneret having elongate radial bosses.

As illustrated by FIGS. 3, 4 and 5, but not exclusive thereof, the elongate bosses 42 can be provided in a myriad of configurations such as spiral, semi-circular and radial, respectively. Each spiral shaped boss 42 is shaped as being wound around a fixed datum point at a continuously increasing or decreasing distance from the datum point. Each semi-circular boss 42 is shaped as arcing about a fixed datum point. Each radial boss 42 linearly extends from a center point of the spinneret 16. Other linear and curvilinear configurations for bosses 42 are within the scope of the invention.

Each elongate boss 42 has the same configuration and preferably has a uniform width, and preferably each pathway 44 has the same configuration and has a varying width. Alternatively, each pathway width can be uniform. Current manufacturing restrictions require a separation of at least one millimeter between adjacent bosses 42. The present invention incorporates advances in manufacturing techniques such that the bosses 42 can be spaced closer than today's current limitation. In each case, the bosses 42 contain a plurality of orifices 27 along a centerline 46 of the boss 42. A minimum distance is required between the edge of each orifice 27 and the side of the boss 42 for sufficient pressure drop. The distance between adjacent orifices on the same boss 42 is restricted only by current manufacturing techniques, and therefore, orifices need only be spaced apart such that one orifice does not breach another orifice. As shown in FIG. 2, each orifice 27 has a counterbore 48 top portion and a narrower capillary 50 bottom portion to provide a filament of desired diameter. Since a plurality of orifices 27 are provided in each boss 42, a higher density of orifices 27 can be provided than prior art spinnerets 16 which contain one orifice 27 per boss 42. Consequently, a greater number of filaments can be produced per unit area of spinneret 16.

In use, the distributor 12 forms the core polymer into filaments and directs the flow of sheath polymer to the spinneret 16. The core polymer is pumped to, then through, the outer passages 22 and is received by the spinneret orifices 27. The sheath polymer is pumped through the inner passages 24 to the central hub 34 of the spinneret 16. The sheath polymer flows outwardly in the feed channels 40 to the recessed section 36 of the spinneret 16. The pressure drop between the top surface of the boss 42 and the bottom surface of the distributor 12, and the pressure drop between the channels and the bottom of the distributor creates an overall pressure drop forcing the sheath polymer through the pathways 44 and over the bosses 42 to the orifices 27. The pathways 44 slope upward toward the outer rim 38 to compensate for the reduced volume of sheath polymer, and maintain uniform pressure for even flow.

Since the distributor outer passages 22 are in coaxial alignment with the corresponding orifices 27, the core polymer flows from the outer passages, through the spinneret orifices 27, and exits the spinneret 16 as a core of a bicomponent fiber. The sheath polymer flows through the inner passages 24, outwardly through the feed channels 40, into the recessed section 36 of the spinneret 16, over the bosses 42 to form a sheath about the core polymer and exits the orifices 27 where it is cooled and forms as a bicomponent fiber.

The spinneret assembly can also be employed to produce sheath core bicomponent fibers where the core has a non-circular cross section. Examples of non-circular cross sections are shown in U.S. Pat. No. 5,256,050 to Davies and are herein incorporated by reference.

Although particular embodiments of the invention have been described in detail, it will be understood that the invention is not limited correspondingly in scope, but includes all changes and modifications coming within the spirit and terms of the claims appended hereto.

We claim:

1. A spinneret assembly for the production of sheath-core bicomponent filaments comprising:

a distributor having a plurality of core polymer flow passages and a sheath polymer flow passage;

a spinneret secured relative to said distributor;

a boss integral with said spinneret, said boss having a plurality of openings which extend through said boss and said spinneret, said openings coaxially aligned with a respective outlet of said polymer flow passages; and a recessed pathway adjacent to said boss.

2. The spinneret assembly of claim 1 further including a plurality of bosses integral with said spinneret, said bosses having a plurality of openings.

3. The spinneret assembly of claim 2 wherein said bosses are elongate and curvilinear.

4. The spinneret assembly of claim 3 wherein said bosses are spiral.

5. The spinneret assembly of claim 3 wherein said bosses are semi-circular.

6. The spinneret assembly of claim 2 wherein said bosses are linear.

7. The spinneret assembly of claim 6 wherein said bosses radially extend.

8. The spinneret assembly of claim 2 wherein said bosses are substantially uniform in width.

9. The spinneret assembly of claim 2 wherein said openings are substantially positioned along a centerline of said bosses.

10. The spinneret assembly of claim 2 wherein said spinneret further includes a channel for receiving sheath polymer from said distributor and for conveying the sheath polymer to said recessed pathway.

11. The spinneret assembly of claim 2 further including a shim secured between said distributor and said spinneret.

12. The spinneret assembly of claim 11 further including a plurality of recessed pathways adjacent to said bosses, said recessed pathways having a substantially uniform width.

* * * * *